US006429887B2

(12) United States Patent
Obata et al.

(10) Patent No.: US 6,429,887 B2
(45) Date of Patent: Aug. 6, 2002

(54) THERMAL PRINTHEAD AND METHOD OF MAKING THE SAME

(75) Inventors: Shinobu Obata; Yasuhiro Yoshikawa, both of Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 09/781,244

(22) Filed: Feb. 13, 2001

(30) Foreign Application Priority Data

Feb. 14, 2000 (JP) ..... 2000-35123

(51) Int. Cl.[7] ..... B41J 2/335
(52) U.S. Cl. ..... 347/200
(58) Field of Search ..... 347/200; 29/611

(56) References Cited

U.S. PATENT DOCUMENTS 6,229,557 B1 * 5/2001 Ooyama ..... 347/200

FOREIGN PATENT DOCUMENTS

EP 1048473 * 11/2000
JP 5-221001 * 8/1993
JP 6-255153 * 9/1994
JP 8-258310 * 10/1996

* cited by examiner

*Primary Examiner*—Huan Tran
(74) *Attorney, Agent, or Firm*—Michael D. Bednarek; Shaw Pittman LLP

(57) ABSTRACT

The thermal printhead according to the present invention includes an elongated rectangular substrate including an attaching surface and a non-attaching surface, and a heat sink plate attached to the attaching surface of the substrate. The non-attaching surface of the substrate is provided with a common electrode, a plurality of individual electrodes and a heating resistor. The heating resistor is covered with an insulating protective layer and an opaque conductive protective layer. The thermal printhead includes a positioning indicia. In the method of making the thermal printhead according to the present invention, an image of the positioning indicia is taken by an image pick-up device and imaged on a display of a monitor. Two reference lines are set on the display of the monitor. Positioning of the substrate relative to the heat sink plate is performed by moving the substrate so that the reference line of the positioning indicia coincides with the reference line on the display of the monitor.

9 Claims, 7 Drawing Sheets

THERMAL PRINTHEAD AND METHOD OF MAKING THE SAME

BACKGROUND OF THE INVENTION

1. Field of the Invention

The present invention relates to a thermal printhead for recording on a recording medium such as a paper thermosensitively or by thermal transfer. The present invention also relates to a method of making such a thermal printhead.

2. Description of the Related Art

FIGS. 9 through 11 illustrate a conventionally used thick film type thermal printhead. The thermal printhead X' includes a substrate 1' and a heat sink plate 2' each of which is in the form of an elongated rectangle The substrate 1' is provided with a glaze layer 3' formed thereon. The glaze layer 3' serves as a heat-retaining layer. The glaze layer 3' is formed with a common electrode 4', a plurality of individual electrodes 5' and a heating resistor 6'. Further, a plurality of drive ICs 8' are mounted on the glaze layer 3'.

The common electrode 4' comprises a plurality of comb-teeth 41' and a common line 40' connected to one end of each comb-tooth 41'. Each of the individual electrodes 5' has one end 5*a*' extending between two adjacent comb-teeth 41'.

The heating resistor 6' extends across the comb-teeth 41' and the respective ends 5*a*' of the individual electrodes 5'.

The common electrode 4', the individual electrodes 5' and the heating resistor 6' are protected by an insulating protective layer 60'. The insulating protective layer 60' may be made of glass for example and is transparent. Therefore, it is possible to view the common electrode 4', the individual electrodes 5' and the heating resistor 6' through the insulating protective layer 60'.

The other end 5*b*' of each individual electrode 5' is connected to the corresponding drive IC 8' via a wire W1'. The drive ICs 8' are protected by a hard coating layer 81'.

The substrate 1' is bonded to the heat sink plate 2'. As clearly shown in FIG. 12, the bonding is performed by forming an adhesive layer 20' on the heat sink plate 2' and pressing the substrate 1' onto the adhesive layer.

In bonding, it is necessary to precisely position the substrate 1' relative to the heat sink plate 2' so that the heating resistor 6' is positioned in accordance with the customer's specifications. For positioning the substrate 1' relative to the heat sink plate 2', use is made of a positioning apparatus (not shown) for example. The positioning apparatus comprises a fixing base for fixing the heat sink plate 2', an image pick-up device 91 for detecting the absolute position of the heat sink plate on the fixing base, and a monitor 93 for displaying the image taken by the image pick-up device.

The monitor has a display provided with an X-reference line $X_0'$ extending longitudinally of the heat sink plate 2' and a Y-reference line $Y_0'$ extending widthwise of the heat sink plate 2'. The operator positions the substrate 1' while watching, via the display of the monitor, the image taken by the image pick-up device. For example, the operator moves the substrate 1' manually so that the heating resistor 6' overlaps the X-reference line $X_0'$, whereas the end 5*a*' of a selected individual electrode 5' (or a selected comb tooth 41') overlaps the Y-reference line $Y_0'$.

As shown in FIG. 14, the thermal printhead X' may be formed with a conductive protective layer 61'. The conductive protective layer 61' covers the heating resistor 6' via the insulating protective layer 60'. The conductive protective layer 61' is provided to prevent electrostatic breakdown of the heating resistor 6'. The conductive protective layer 61' may be formed of a material containing carbon black for example to provide conductivity. In this case, the conductive protective layer 61' is black and opaque for example.

Thus, in the thermal printhead X as shown in FIG. 14, the common electrode 4', the ends 5*a*' of the individual electrodes 5' and the heating resistor 6' cannot be viewed because they are covered with the conductive protective layer 61' which is opaque. Therefore, as shown in FIG. 15, the common electrode 4', the individual electrodes 5' and the heating resistor 6' cannot be viewed on the display of the monitor of the positioning apparatus. As a result, with the above-described positioning apparatus, it is not possible to position the substrate 1' relative to the heat sink plate 2' by referring to the positions of the heating resistor 6' for example.

SUMMARY OF THE INVENTION

It is, therefore, an object of the present invention to precisely position a substrate relative to a heat sink plate in making a thermal printhead having a heating resistor provided on the substrate and covered with an opaque conductive protective layer.

In accordance with a first aspect of the prevent invention, there is provided a thermal printhead comprising an elongated rectangular substrate including an attaching surface and a non-attaching surface, and a heat sink plate attached to the attaching surface of the substrate, the non-attaching surface of the substrate being provided with a common electrode, a plurality of individual electrodes, a heating resistor extending longitudinally of the substrate in conduction with the common electrode and the individual electrodes, an insulating protective layer and an opaque conductive protective layer for covering the heating resistor. The thermal printhead further includes a positioning indicia which serves as a reference for positioning the substrate relative to the heat sink plate.

Preferably, the positioning indicia may be provided on the non-attaching surface of the substrate at a portion avoiding the conductive protective layer.

Preferably, the positioning indicia may include a first positioning reference portion extending longitudinally of the substrate and a second positioning reference portion extending widthwise of the substrate. The positioning indicia may comprise a cross for example.

Preferably, one of the first and the second positioning reference portions may be formed of the same material as that of the heating resistor, whereas the other one of the first and the second positioning reference portions may be formed of the same material as that of the common electrode and the individual electrodes.

Preferably, the positioning indicia may comprise a plurality of positioning marks. One of the positioning marks may be arranged at one end of the substrate, whereas another of the positioning marks may be arranged at the other end of the substrate.

In accordance with a second aspect of the present invention, there is provided a method of making a thermal printhead comprising an elongated rectangular substrate including an attaching surface and a non-attaching surface, and a heat sink plate attached to the attaching surface of the substrate, the non-attaching surface of the substrate being provided with a common electrode, a plurality of individual electrodes, a heating resistor in conduction with the common electrode and the individual electrodes, an insulating protective layer and an opaque conductive protective layer for covering the heating resistor, and a positioning indicia including a first positioning reference portion having a first positioning reference line and a second positioning reference portion having a second positioning reference line. The method comprises the steps of forming the common electrode and the plurality of individual electrodes, forming the heating resistor, positioning the substrate relative to the heat sink plate, and attaching the substrate onto the heat sink plate. The step of positioning the substrate utilizes an image pick-up device for picking up an image of the positioning indicia and a monitor having a display on which a first reference line and a second reference line are set. The substrate is so moved that the first and the second positioning reference lines imaged on the monitor coincide with the first and the second reference lines, respectively.

Preferably, the first reference line extends longitudinally of the substrate, and the second reference line extends widthwise of the substrate. The first reference line and the second reference line intersect at right angles.

Preferably, the positioning indicia may include a first positioning mark and a second positioning mark. The first positioning mark may be arranged at one end of the substrate, and the second positioning mark may be arranged at the other end of the substrate. The positioning step may include positioning the substrate relative to the heat sink plate with reference to the first positioning mark and thereafter positioning the substrate relative to the heat sink plate with reference to the second positioning mark.

Preferably, the first positioning reference portion may be formed in the step of forming the electrodes, and the second positioning reference portion may be formed in the step of forming the heating resistor. The entirety of the positioning indicia may be formed at once in the step of forming the electrodes. Alternatively, the entirety of the positioning indicia may be formed at once in the step of forming the heating resistor.

DETAILED DESCRIPTION OF THE PREFERRED EMBODIMENT

Figure 1:
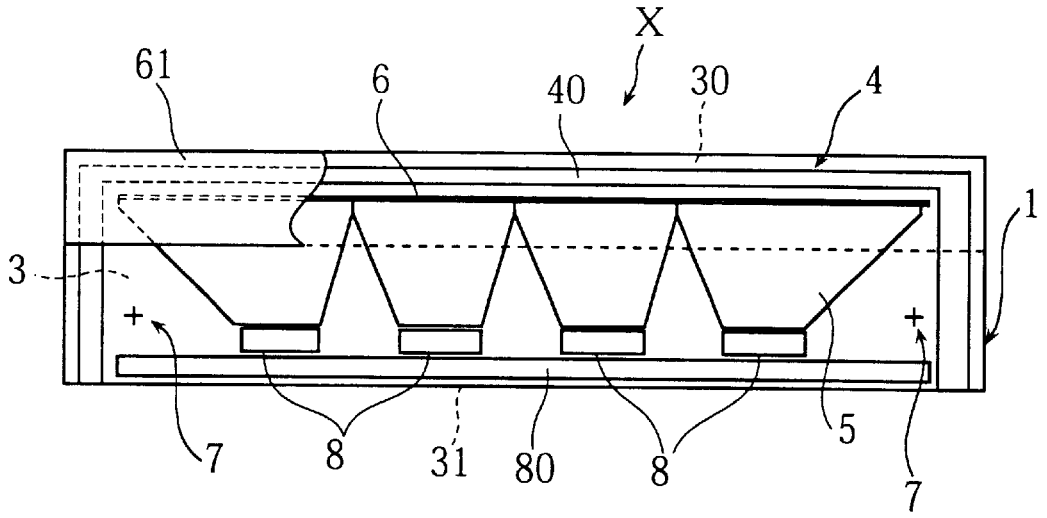
FIG. 1 is a plan view showing an example of thermal printhead in accordance with the present invention.
Figure 2:
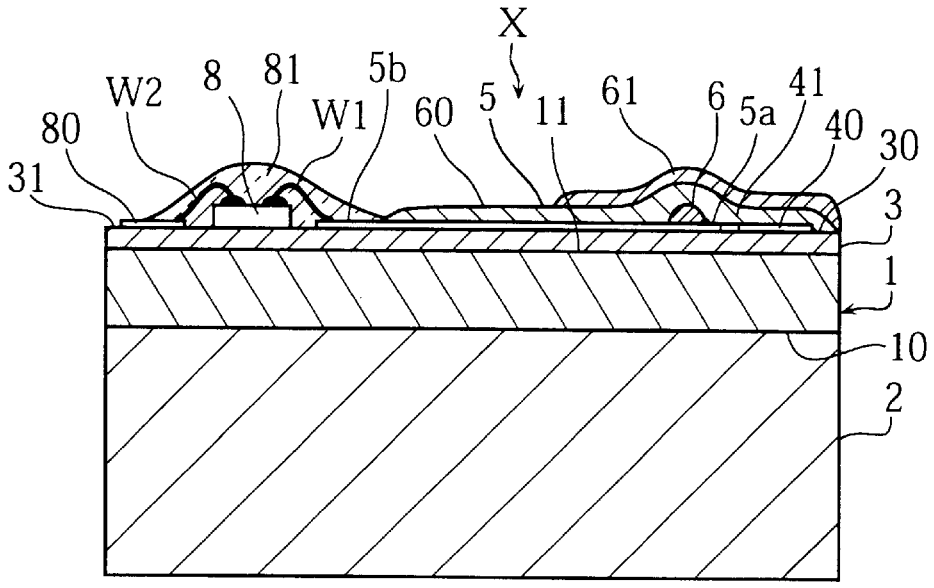
FIG. 2 is a sectional view of the thermal printhead shown in FIG. 1.
Figure 3:
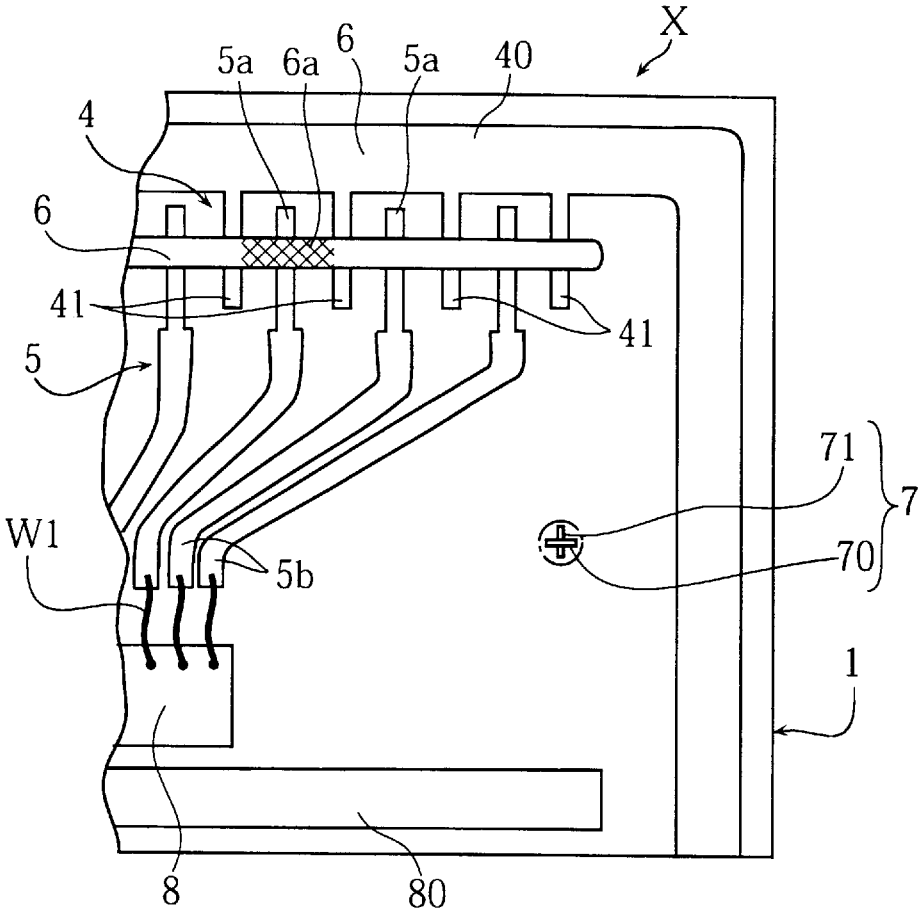
FIG. 3 is an enlarged plan view showing principal portion of the thermal printhead shown in FIG. 1.

Referring to FIGS. 1 through 3, a thermal printhead X includes a substrate 1 having an attaching surface 10 and a non-attaching surface 11, and a heat sink plate 2 attached to the attaching surface 10 of the substrate 1.

The substrate 1, which may be made of an insulating material such as alumina, has an elongated rectangular configuration.

The heat sink plate 2, which is made of a highly heat conductive material such as aluminum, has an elongated rectangular configuration.

The substrate 1 is bonded to the heat sink plate 2 with a double-sided adhesive tape or bonding resin.

The non-attaching surface 11 of the substrate 1 is entirely covered with a glaze layer 3 which serves as a heat-retaining layer. The glaze layer 3 may be made of glass material for example.

The glaze layer 3 is upwardly formed with a common electrode 4, a plurality of individual electrodes 5, a heating resistor 6 and two positioning marks 7. Further, a plurality of drive ICs 8 are mounted on the glaze layer 3.

The common electrode 4 comprises a common line 40 extending longitudinally of the substrate 4, and a plurality of comb-teeth 41 extending from the common line 40 widthwise of the substrate 4.

Each of the individual electrodes 5 extends generally widthwise of the substrate 1. Each of the individual electrodes 5 has one end 5*a* extending between two adjacent comb-teeth 41, and the other end 5*b* of the individual electrode is located adjacent a corresponding drive IC 8.

The heating resistor 6 extends longitudinally of the substrate 1 adjacent one edge 30 of the glaze layer 3. The heating resistor 6 extends across the comb-teeth 41 and the respective ends 5*a* of the individual electrodes 5. A portion of the heating resistor 6 between each two adjacent comb-teeth 41 serves as an individual heating region 6*a* (crisscross-hatched portion in FIG. 3). Thus, the heating resistor 6 provides a plurality of heating elements 6*a* arranged longitudinally thereof. The heating resistor 6 may be made of $RuO_2$ for example.

As clearly shown in FIG. 2, the heating resistor 6 is covered with an insulating protective layer 60 and a conductive protective layer 61.

The insulating protective layer 60 may be made of hard glass for example.

An ink ribbon or a thermosensitive paper slidably moves over the conductive protective layer 61, generating static electricity. The static electricity is allowed to escape via the conductive protective layer 61, thereby preventing electrostatic breakdown of the heating resistor 6. Therefore, the conductive protective layer 61 needs to be conductive, wear-resistant and slippery. For this purpose, the conductive protective layer 61 may be formed of a material obtained by adding carbon black to titanium nitride or SiC for example, thereby having an opaque color such as black.

The positioning marks 7 serve as marks for positioning the substrate 1 relative to the heat sink plate 2 in making the thermal printhead X. The positioning marks 7 are formed on the glaze layer 3 at longitudinally opposite ends of the substrate 1, as clearly shown in FIGS. 1 and 3. When the thermal printhead X is viewed in plan, the positioning marks 7 are so positioned as to avoid portions covered with the conductive protective layer 61. Since the conductive protective layer 61 is made opaque, it is necessary to provide the positioning marks 7 so as to avoid the conductive protective layer 61 for reliable viewing of the positioning marks 7.

Alternatively, the positioning marks 7 may be formed on the conductive protective layer 61. In this case, the positioning marks 7 needs to have a color distinguishable from the protective layer. For example, in the case where the conductive protective layer 61 is black, the positioning marks 7 need to be made white for example.

Figure 4:
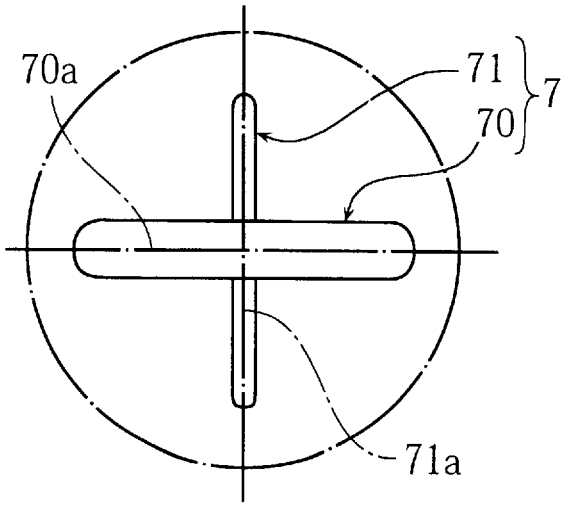
FIG. 4 is an enlarged plan view showing the region surrounded by chain lines in FIG. 3.

As clearly shown in FIG. 4, each of the positioning marks 7 comprises a first positioning reference portion 70 and a second positioning reference portion 71 intersecting at right angles.

The first positioning reference portion 70 is in the form of a bar extending longitudinally of the substrate 1. The first positioning reference portion 70 has an axis 70*a* which serves as a first positioning reference line. The first positioning reference portion 70 may be formed of the same material as that used for forming the common electrode 4 and the individual electrodes 5.

The second positioning reference portion 71 is in the form of a bar extending widthwise of the substrate 1. The second positioning reference portion 71 has an axis 71*a* which serves as a second positioning reference line. The second positioning reference portion 71 may be formed of the same material as that used for forming the heating resistor 6.

The first positioning reference portion 70 and the second positioning reference portion 71 may be formed of the same material. For example, each of the positioning marks 7 may be entirely formed of the same material as that used for forming the common electrode 4 and the individual electrodes 5 or that used for forming the heating resistor 6. Alternatively, the positioning mark 7 may be formed of a material different from that used for forming the common electrode 4 or the heating resistor 6.

The number of the positioning marks 7 is not necessarily limited to two. For example, only one positioning mark 7 or no less than three positioning marks 7 may be provided.

Each of the drive ICs 8 controls power supply to the heating resistor 6 in accordance with the printing data. As clearly shown in FIG. 1, the drive ICs 8 are arranged adjacent the other edge 31 of the glaze layer 3 in a row extending longitudinally of the substrate 1. As clearly shown in FIG. 2, each of the drive ICs 8 is connected to the respective ends 5*b* of the corresponding individual electrodes 5 via conductive wires W1. The drive IC 8 is electrically connected to a conductive pattern 80 via conductive wires W2. The conductive pattern 80 is connected to a non-illustrated connector for performing input/output of various signals and power supply with respect to the drive ICs 8.

The drive ICs 8 and the conductive wires W1, W2 are covered with a hard coating layer 81 formed of resin, as clearly shown in FIG. 2.

With the thermal printhead X, when power is applied to a selected one of the individual electrodes 5 via the corresponding drive IC 8, current passes through the end 5*a* of this individual electrode 5 and a portion of the heating resistor 6 between two comb-teeth 41 sandwiching this end 5*a*. In this way, the selected heating region 6*a* is heated, thereby printing one dot of image on a thermosensitive paper for example.

Next, a method of making the thermal printhead X shown in FIGS. 1 through 4 will be described.

First, a glaze layer 3 is formed on an attaching surface 11 of a substrate 1. The glaze layer may be formed by printing a glass paste on the substrate 1 followed by baking the paste at a temperature of about 1200° C. for example.

Then, a common electrode 4, a plurality of individual electrodes 5, second positioning reference portions 71 of positioning marks 7 and a conductive pattern 80 are simultaneously formed on the glaze layer 3. These elements may be provided by forming a conductor layer of e.g. gold on the glaze layer 3*a* by plating or vapor deposition for example, forming a mask by known photolithography and etching away unnecessary portions. Alternatively, the elements such as the common electrode 4 may be provided by forming a mask on the glaze layer 3 by known photolithography followed by printing a conductor paste, removing the mask and baking the conductor paste.

In the above step of forming electrodes, not only a second positioning reference portion 71 but also a first positioning reference portion 70 may be formed at the same time to complete a positioning mark 7. The positioning mark 7 may be easily provided by specially patterning, through photolithography, a mask having an opening for such a purpose.

Then, a heating resistor 6 and a first positioning reference portion 70 are simultaneously formed on the glaze layer 3. The heating resistor 6 and the first positioning reference portion 70 are formed by screen printing and baking for example. In screen printing, a resistor paste is applied in the form of a bar extending across the comb-teeth 41 of the common electrode 4 and the respective ends 5*a* of the individual electrodes 5. At the same time, in screen printing, the resistor paste is also applied in the form of a bar intersecting the second reference portion 71 at right angles. The application of the resistor paste can be easily performed by using, in screen printing, a specially patterned mask having openings for such a purpose.

The resistor paste may contain $RuO_2$, ruthenate, or indium oxide as a resistor material.

In the above step of forming the heating resistor, not only a first positioning reference portion 70 but also a second positioning reference portion 71 may be formed at the same time to complete a positioning mark 7. The positioning mark 7 may be easily provided by using a specially patterned mask having an opening for such a purpose.

The positioning mark 7 can be formed either in one step or in two steps of forming the electrodes and forming the heating resistor. Therefore, an additional step for forming the positioning mark 7 is not necessary, which is advantageous in view of the manufacturing cost.

Subsequently, an insulating protective layer 60 is formed to cover the common electrode 4, the individual electrodes 5, the heating resistor 6 and the positioning marks 7. The insulating protective layer 60 is formed by printing a paste containing a wear-resistant substance and baking the paste at a temperature of about 400° C. for example. In the case where the insulating protective layer 60 also covers the positioning marks 7, the insulating protective layer 60 is made transparent so that the positioning marks 7 can be viewed through the insulating protective layer 60.

Then, a conductive protective layer 61 is formed to cover the heating resistor 6 via the insulating protective layer 60. The conductive protective layer 61 may be formed by printing a paste comprising a mixture of powder of titanium nitride or SiC and powder of carbon black and then baking the paste. Alternatively, the conductive protective layer may be formed by growing a metal film through vapor deposition or spattering.

Subsequently, a plurality of drive ICs 8 are mounted on the glaze layer 3. The drive ICs 8 may be bonded onto the glaze layer 3 with a bonding resin for example.

Then, each of the drive ICs 8 is connected to the ends 5*b* of the corresponding individual electrodes 5 via conductive wires W1 and is also connected to the conductive pattern 80 via the conductive wire W2. Such connection via the wires W1, W2 can be performed by a conventional wire bonder.

Figure 5:
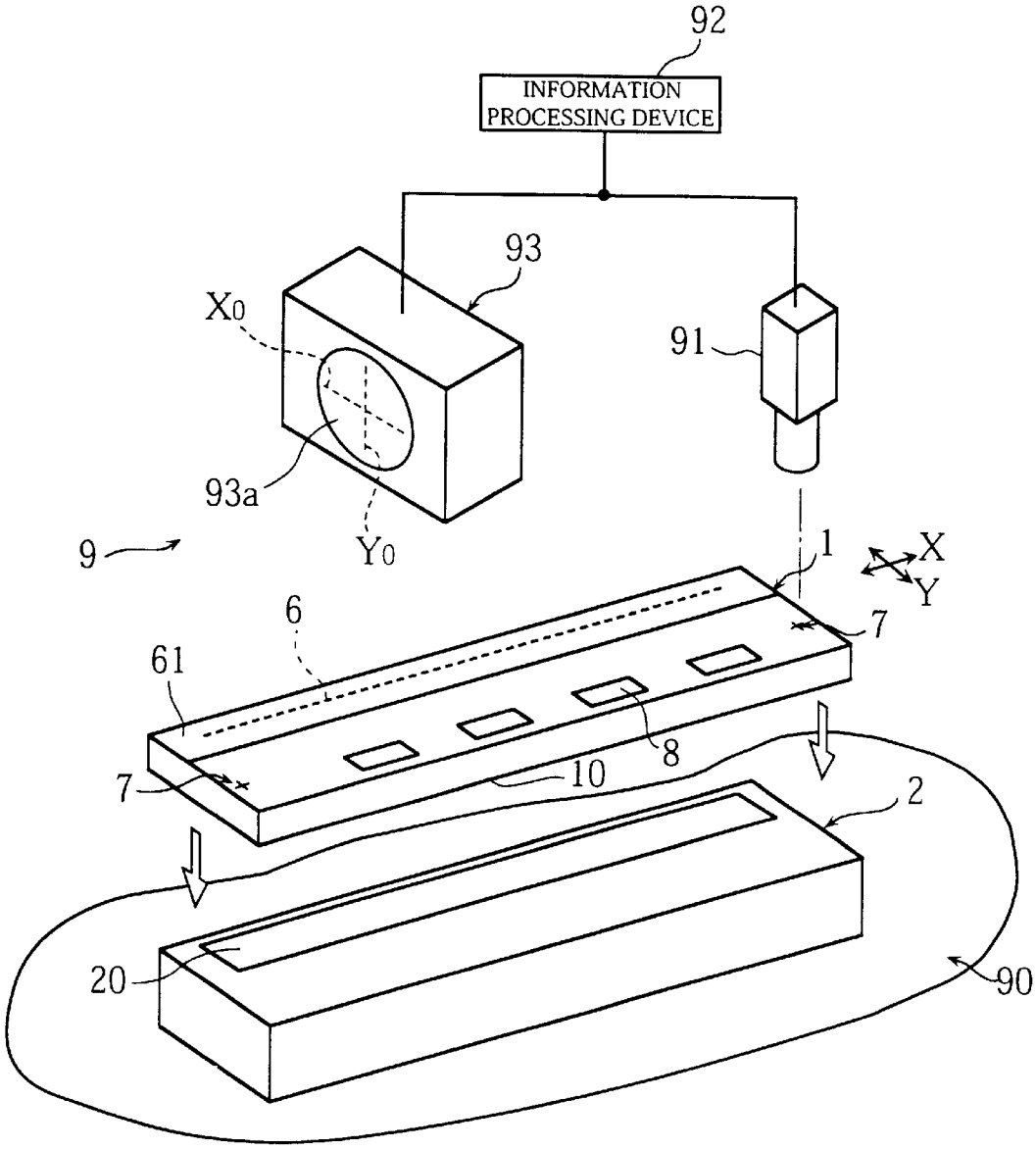
FIG. 5 is a schematic view illustrating the process for positioning a substrate relative to a heat sink plate.

Then, a hard coating layer 81 is formed to cover the drive ICs 8 and the wires W1, W2. The hard coating layer 81 may be formed by potting a melt resin and hardening the resin. Subsequently, the substrate 1 is positioned relative to the heat sink plate 2 and bonded thereto. As shown in FIG. 5, bonding of the substrate 1 to the heat sink plate 2 is performed by forming, on the heat sink plate 2, an adhesive layer 20 which is utilized for bonding the substrate 1. The adhesive layer 20 may be provided by applying an adhesive or a double-sided adhesive tape on the heat sink plate 2.

On the other hand, positioning of the substrate 1 relative to the heat sink plate 2 is performed utilizing a positioning apparatus 9, as shown FIG. 5. The positioning apparatus 9 comprises a fixing base 90, an image pick-up device 91, an information processing device 92, and a monitor 93.

The image pick-up device 91 includes a light source and an image sensor for example. Light emitted from the light source illuminates the surface of the substrate 1 and is reflected thereon toward the image sensor. The image sensor outputs signals in accordance with the received light for transmission to the information processing device 92.

The information processing device 92, which includes a CPU, a ROM and a RAM for example, converts information from the image sensor into image information for transmission to the monitor 93.

The monitor 93 has a display 93*a* which shows the state of the substrate 1 based on the image information from the information processing device 92. As clearly shown in FIGS. 5 and 6, the display 93*a* is provided with an X-reference line $X_0$and a Y-reference line $Y_0$. The X-reference line $X_0$ extends longitudinally of the heat sink plate 2, whereas the Y-reference line $Y_0$ extends widthwise of the heat sink plate 2. The X-reference line $X_0$ and the Y-reference line $Y_0$ intersect at right angles. Hereinafter, the longitudinal direction of the heat sink plate 2 is defined as the X direction, whereas the widthwise direction of the heat sink plate 2 is defined as the Y direction.

Positioning of the substrate 1 using these devices 90~93 is performed with the heat sink plate 2 disposed on the fixing base 90. First, the substrate 1 is located above the heat sink plate 2 manually by an operator for example. At this time, it is possible to see whether the substrate 1 is precisely positioned relative to the heat sink plate 2 by watching the display 93*a* of the monitor 93.

Figure 6:
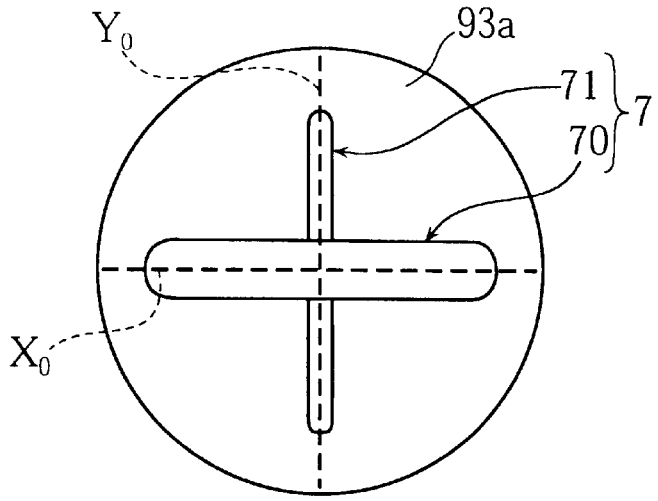
FIG. 6 is a front view showing a positioning mark as seen on the display of a monitor.

When the substrate 1 is precisely positioned relative to the heat sink plate 2, the display 93*a* of the monitor 93 displays such a state as shown in FIG. 6. That is, the axis 70*a* (See FIG. 4) of the first positioning reference portion 70 coincides with the X-reference line $X_0$ of the display 93*a*, whereas the axis 71*a* (See FIG. 4) of the second positioning reference portion 71 coincides with the Y-reference line $Y_0$ of the display 93*a*.

On the other hand, when even either one of the axis 70*a* (See FIG. 4) of the first positioning reference portion 70 and the axis 71*a* (See FIG. 4) of the second positioning reference portion 71 is offset from the respective reference lines $X_0$, $Y_0$, of the display 93*a*, the substrate 1 is moved in the X direction and/or in the Y direction for precise positioning of the substrate. Specifically, while watching the display 93*a*, the operator moves the substrate 1 manually for example so that the axes 70*a*, 71*a* (See FIG. 4) coincide with the reference lines $X_0$, $Y_0$, respectively.

The substrate 1 may be automatically moved using a two-dimensional actuator capable of moving the substrate 1 both in the X direction and the Y direction.

Although the positioning marks 7 are provided at the longitudinally opposite ends of the substrate 1, the positioning operation utilizing one of the positioning marks 7 is sufficient for positioning the substrate 1 relative to the heat sink plate 2. However, for more reliable positioning, the positioning operation utilizing one of the positioning marks 7 may be supplemented by the subsequent positioning operation utilizing the other of the positioning marks 7.

In the case where a plurality of positioning marks 7 are provided, a corresponding number of image pick-up devices 91 maybe provided so that positioning utilizing the plurality of positioning marks 7 can be performed simultaneously.

In the above-described positioning method, the ends 5*a* of the individual electrodes 5 and the heating resistor 6 are not utilized for positioning the substrate 1. Instead, positioning is performed utilizing the positioning marks 7 provided separately from these elements. Therefore, even in the case where the ends 5*a* of the individual electrodes 5 and the heating resistor 6 are covered with the opaque conductive protective layer 61 and therefore cannot be viewed from the outside, it is possible to reliably position the substrate 1 relative to the heat sink plate 2.

Figure 7:
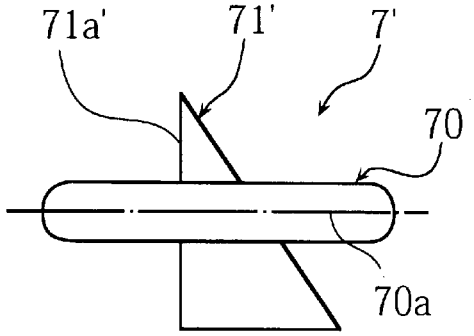
FIG. 7 is a plan view showing another example of positioning mark.
Figure 8:
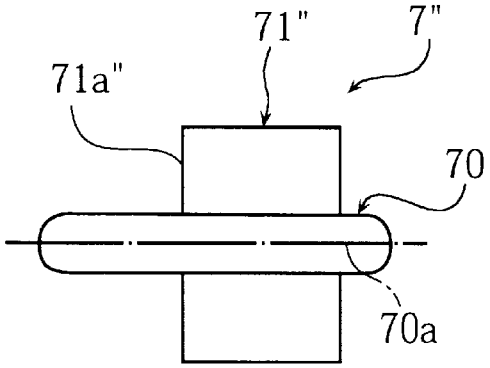
FIG. 8 is a plan view showing a further example of positioning mark.
Figure 9:
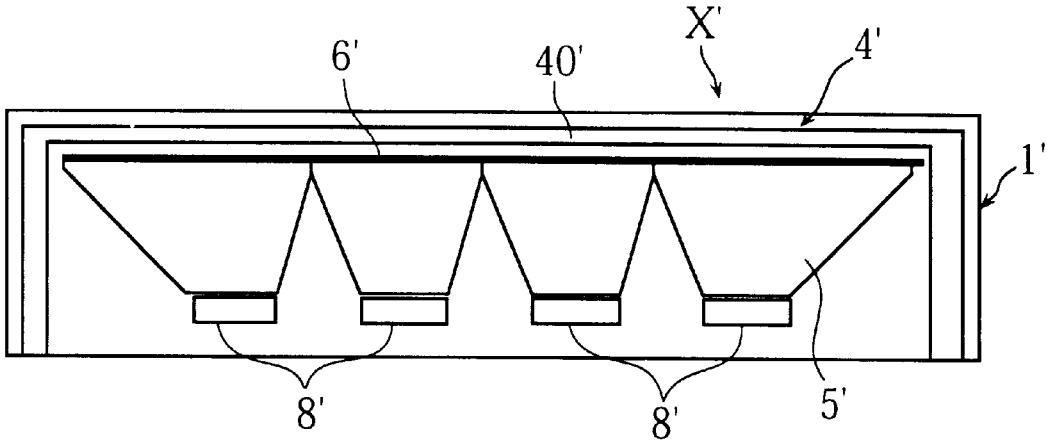
FIG.9 PRIOR ART
FIG. 9 is a plan view showing an example of prior-art thermal printhead.
Figure 10:
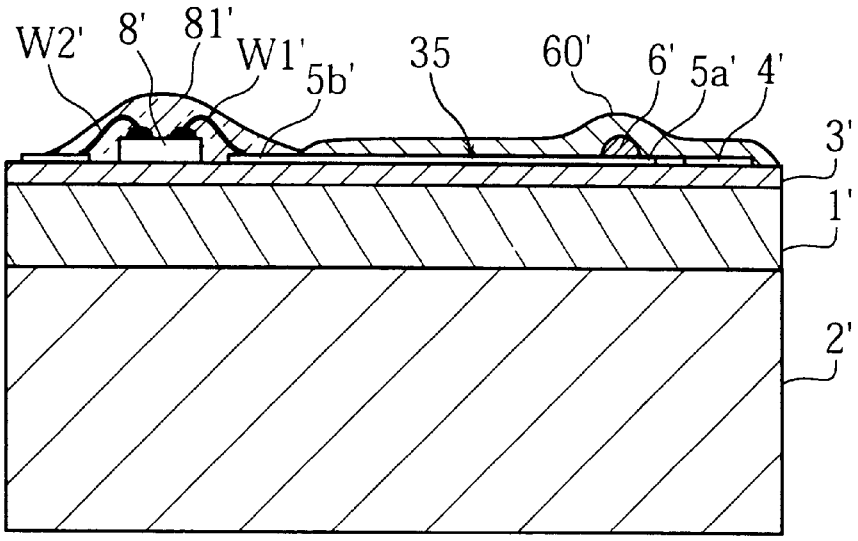
FIG.10 PRIOR ART
FIG. 10 is a sectional view of the thermal printhead as shown in FIG. 9.
Figure 11:
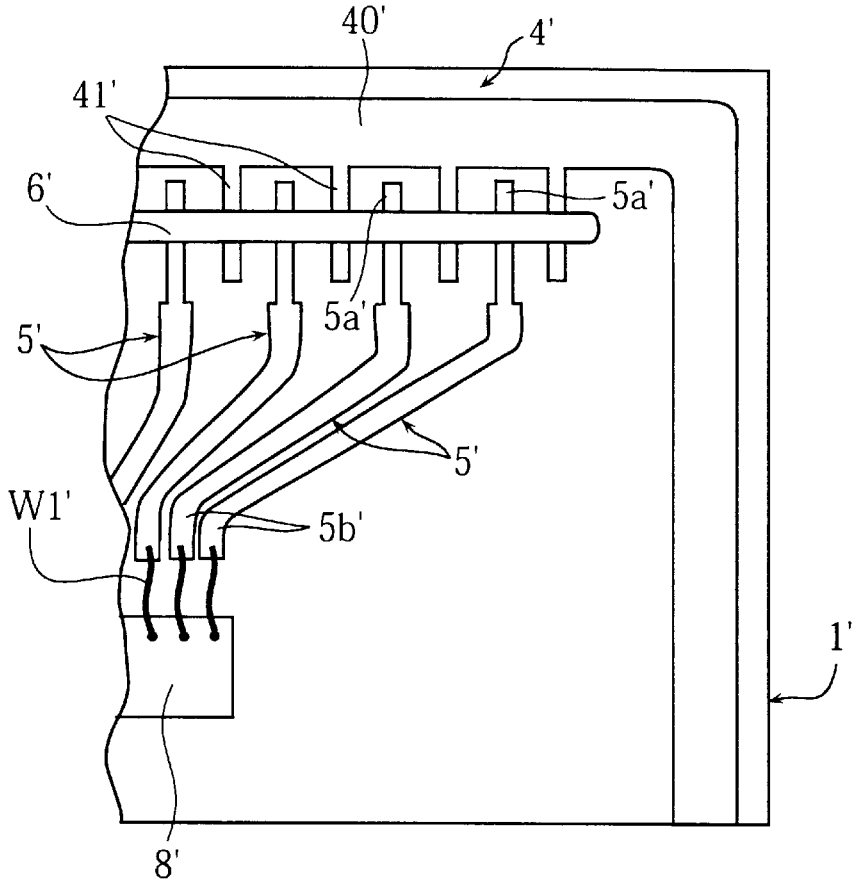
FIG.11 PRIOR ART
FIG. 11 is an enlarged view showing a principal portion of the thermal printhead shown in FIG. 9.
Figure 12:
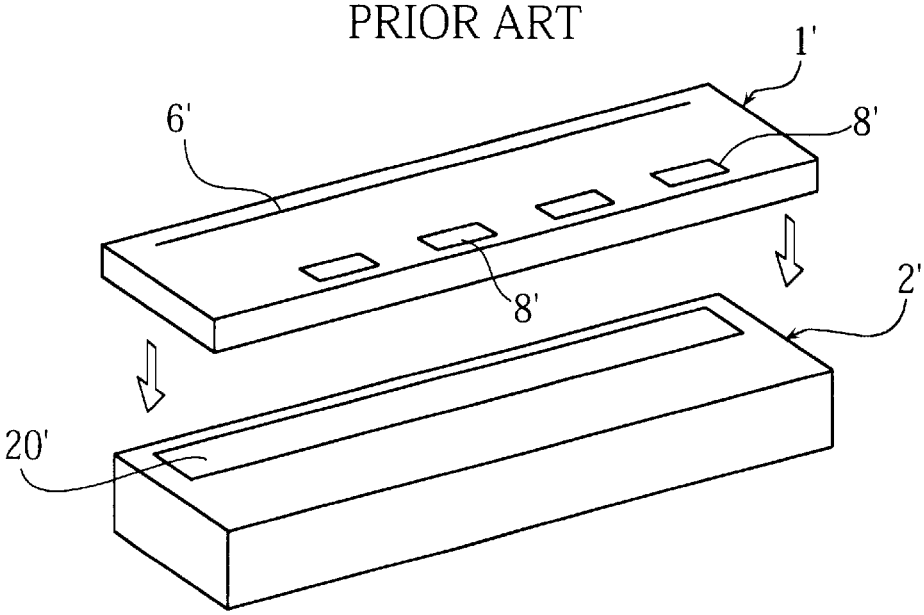
FIG.12 PRIOR ART
FIG. 12 is a perspective view showing the step of attaching a substrate onto a heat sink plate in making a thermal printhead.
Figure 13:
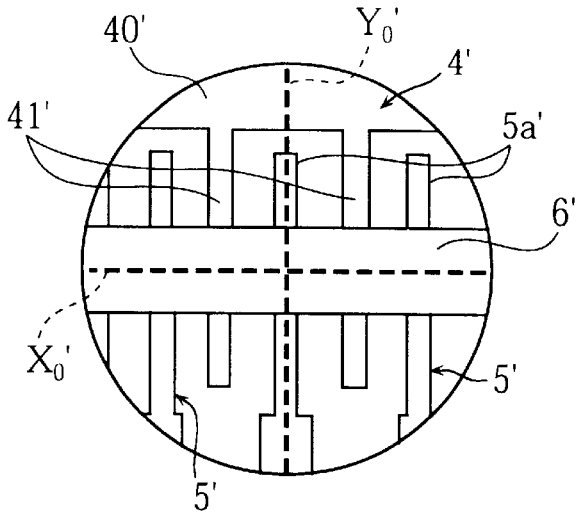
FIG.13 PRIOR ART
FIG. 13 is a front view of the thermal printhead of FIG. 9 as seen on the display of a monitor.
Figure 14:
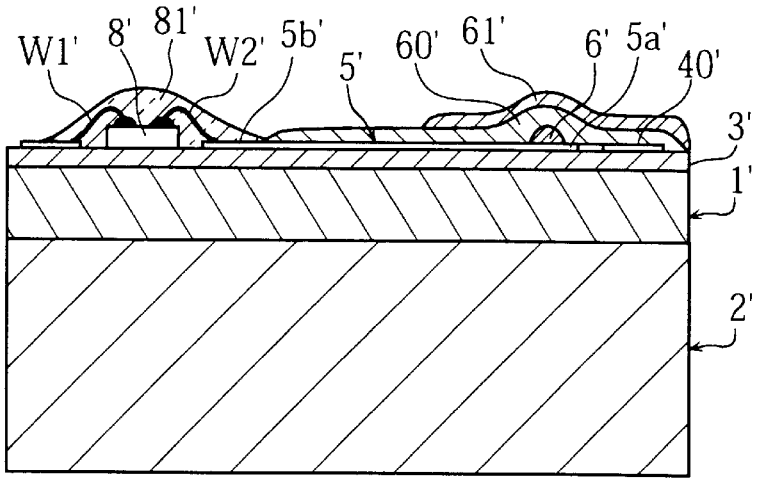
FIG.14 PRIOR ART
FIG. 14 is a sectional view showing another example of prior art thermal printhead.
Figure 15:
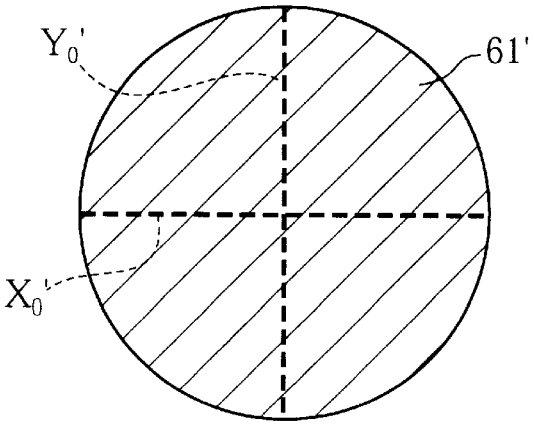
FIG.15 PRIOR ART
FIG. 15 is a view of the thermal printhead of FIG. 14 as seen on a monitor.

The structure of the thermal printhead X is not limited to that shown in FIGS. 1~4. The positioning mark may have such a configuration as shown in FIG. 7 or 8. Each of the illustrated positioning marks 7', 7" has a first positioning reference portion 70 which has the same configuration as that of the positioning mark 7 shown in FIG. 4. On the other hand, the differences from the positioning mark 7 shown in FIG. 4 resides in that the positioning mark 7' shown in FIG. 7 has a second positioning reference portion 71, which is triangular, whereas the positioning mark 7' shown in FIG. 8 has a second positioning reference portion 71" which is rectangular. Each of the positioning marks 7', 7" shown in FIG. 7 or 8 has a side 71*a*' or 71*a*" intersecting an axis 70*a* of the first positioning reference portion 70 at right angles. Each of the sides 71*a*', 71*a*" serves as a second positioning reference line.

Each of the first and the second positioning reference portions may be otherwise configured provided that it has a reference line.

What is claimed is:

1. A thermal printhead comprising: an elongated rectangular substrate including an attaching surface and a non-attaching surface, and a heat sink plate attached to the attaching surface of the substrate, the non-attaching surface of the substrate being provided with a common electrode, a plurality of individual electrodes, a heating resistor extending longitudinally of the substrate in conduction with the common electrode and the individual electrodes, an insulating protective layer and an opaque conductive protective layer for covering the heating resistor, wherein the thermal printhead further includes a positioning indicia which serves as a reference for positioning the substrate relative to the heat sink plate, wherein the positioning indicia includes a first positioning reference portion extending longitudinally of the substrate and a second positioning reference portion extending widthwise of the substrate, and wherein one of the first and the second positioning reference portions is formed of the same material as that of the heating resistor, whereas the other one of the first and the second positioning reference portions is formed of the same material as that of the common electrode and the individual electrodes.

2. The thermal printhead according to claim 1, wherein the positioning indicia is provided on the non-attaching surface of the substrate at a portion avoiding the conductive protective layer.

3. The thermal printhead according to claim 1, wherein the positioning indicia comprises a cross.

4. The thermal printhead according to claim 1, wherein the positioning indicia comprises a plurality of positioning marks.

5. The thermal printhead according to claim 4, wherein one of the positioning marks is arranged at one end of the substrate another of the positioning marks being arranged at the other end of the substrate.

6. A method of making a thermal printhead comprising an elongated rectangular substrate including an attaching surface and a non-attaching surface, and a heat sink plate attached to the attaching surface of the substrate, the non-attaching surface of the substrate being provided with a common electrode, a plurality of individual electrodes, a heating resistor in conduction with the common electrode and the individual electrodes, an insulating protective layer and an opaque conductive protective layer for covering the heating resistor, and a positioning indicia including a first positioning reference portion having a first positioning reference line and a second positioning reference portion having a second positioning reference line; the method comprising the steps of: forming the common electrode and the plurality of individual electrodes, forming the heating resistor, positioning the substrate relative to the heat sink plate, and attaching the substrate onto the heat sink plate;

wherein the step of positioning the substrate utilizes an image pick-up device for picking up an image of the positioning indicia and a monitor having a display on which a first reference line and a second reference line are set, the substrate being so moved that the first and the second positioning reference lines imaged on the monitor coincide with the first and the second reference lines, respectively; and wherein the first positioning reference portion is formed in the step of forming the electrodes, the second positioning reference portion being formed in the step of forming the heating resistor.

7. The method of making a thermal printhead according to claim 6, wherein the first reference line extends longitudinally of the substrate, the second reference line extending widthwise of the substrate, and wherein the first reference line and the second reference line intersect at right angles.

8. The method of making a thermal printhead according to claim 6, wherein the positioning indicia includes a first positioning mark and a second positioning mark, the first positioning mark being arranged at one end of the substrate, the second positioning mark being arranged at the other end of the substrate, and wherein the positioning step includes positioning the substrate relative to the heat sink plate with reference to the first positioning mark and thereafter positioning the substrate relative to the heat sink plate with reference to the second positioning mark.

9. A method of making a thermal printhead comprising an elongated rectangular substrate including an attaching surface and a non-attaching surface, and a heat sink plate attached to the attaching surface of the substrate, the non-attaching surface of the substrate being provided with a common electrode, a plurality of individual electrodes, a heating resistor in conduction with the common electrode and the individual electrodes, an insulating protective layer and an opaque conductive protective layer for covering the heating resistor, and a positioning indicia including a first positioning reference portion having a first positioning reference line and a second positioning reference portion having a second positioning reference line; the method comprising the steps of: forming the common electrode and the plurality of individual electrodes, forming the heating resistor, positioning the substrate relative to the heat sink plate, and attaching the substrate onto the heat sink plate;

wherein the step of positioning the substrate utilizes an image pick-up device for picking up an image of the positioning indicia and a monitor having a display on which a first reference line and a second reference line are set, the substrate being so moved that the first and the second positioning reference lines imaged on the monitor coincide with the first and the second reference lines, respectively; and wherein the entirety of the positioning indicia is formed at once in the step of forming the heating resistor.

* * * * *